United States Patent [19]

Campbell et al.

[11] Patent Number: 4,884,394

[45] Date of Patent: Dec. 5, 1989

[54] FRICTION SPINNING UNIT AND METHOD OF OPERATING SAME

[75] Inventors: John G. Campbell, Greenville, S.C.; Allan Thompson, Rochdale, England

[73] Assignee: Hollingsworth U.K. Ltd., Accrington, England

[21] Appl. No.: 161,803

[22] Filed: Feb. 29, 1988

[30] Foreign Application Priority Data

Mar. 13, 1987 [GB] United Kingdom ..... 8706033
Oct. 5, 1987 [GB] United Kingdom ..... 8723336

[51] Int. Cl.[4] ..... D01H 13/16

[52] U.S. Cl. ..... 57/264; 57/78; 57/401; 57/408; 57/411

[58] Field of Search ..... 57/78, 80, 264, 400, 57/401, 404, 405, 407, 408, 409, 411

[56] References Cited

U.S. PATENT DOCUMENTS

| | | | |
|---|---|---|---|
| 4,056,926 | 11/1977 | Stueber | 57/81 |
| 4,195,345 | 3/1980 | Artzt et al. | 57/264 X |
| 4,246,748 | 1/1981 | Artzt et al. | 57/264 X |
| 4,408,447 | 10/1983 | Sloupensky et al. | 57/264 X |
| 4,543,779 | 10/1985 | Wassenhoven | 57/401 |
| 4,627,230 | 12/1986 | Stahlecker | 57/264 X |
| 4,640,090 | 2/1987 | Lembeck | 57/401 |
| 4,641,494 | 2/1987 | Raasch et al. | 57/401 |
| 4,662,168 | 5/1987 | Stahlecker et al. | 57/401 |
| 4,677,820 | 7/1987 | Stahlecker | 57/401 |
| 4,691,509 | 9/1987 | Stahlecker | 57/264 |
| 4,774,806 | 10/1988 | Stahlecker | 57/264 |

FOREIGN PATENT DOCUMENTS

| | | |
|---|---|---|
| 0034427 | 8/1981 | European Pat. Off. . |
| 2530587 | 1/1977 | Fed. Rep. of Germany . |

*Primary Examiner*—Donald Watkins
*Attorney, Agent, or Firm*—Cort Flint

[57] ABSTRACT

A friction spinning unit of a multi-position friction spinning machine includes a pressure tapping in the suction line to a suction port in the fibre feed duct. A suction transducer responsive to the suction in the tapping controls the fibre feed clutch of that particular friction spinning unit for disengaging the friction spinning unit when suction value sensed by the transducer deviates from a predetermined range of acceptable suction values, to shut-down the friction spinning unit well before the yarn quality has been impaired to a sufficient extent to cause a yarn break.

20 Claims, 1 Drawing Sheet

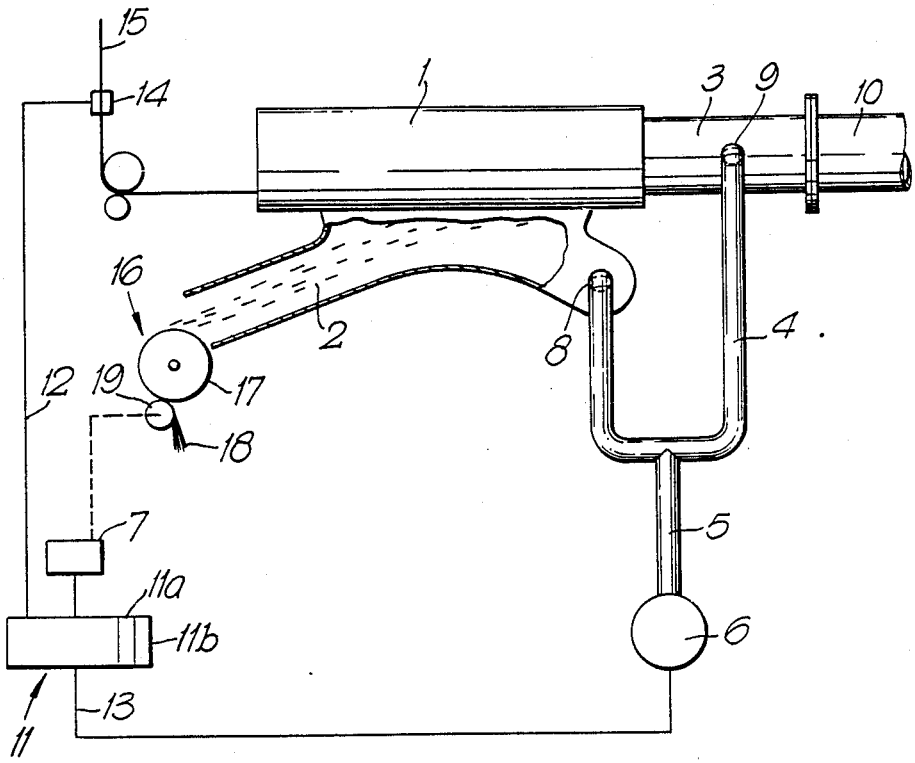
15
14
1
3
9
10
16
2
8
4
12
19
17
18
7
5
11a
11b
6
13
11

FRICTION SPINNING UNIT AND METHOD OF OPERATING SAME

FIELD OF THE INVENTION

The present invention is concerned with friction spinning and in particular with the maintenance of the operating performance of friction spinning apparatus.

Friction spinning uses suction forces to hold fibres on a friction spinning surface, and in some cases additional suction is used to control fibre movement and/or orientation as the fibres pass towards the friction spinning surface(s).

PRIOR ART

DE-A-3342481 discloses a monitor incorporated in a servicing robot for checking the intensity of suction of a friction spinning unit being serviced, and for adjusting the suction (if necessary) in order to restore it to the preferred range of values. Such a servicing robot may be called to a friction spinning unit between doffing and re-piecing, or following a yarn break indicative of the need for restoration of the spinning parameters to the designed values. However, we have found that the quality of friction spun yarn can deteriorate markedly well before yarn break occurs, and during that time the spun yarn will be of impaired quality until such time as eventually yarn break occurs and then the servicing robot disclosed in DE-A-3342481 would be called to investigate and correct the situation.

OBJECT OF THE INVENTION

It is an object of the present invention to anticipate the variation in yarn quality which we believe is directly linked to the suction forces.

It is another object of the present invention to provide apparatus and a method for monitoring continuously the suction applied to a friction spinning unit and for shutting-down that unit if the suction deviates from an optimum range of values.

SUMMARY OF THE INVENTION

Accordingly, one aspect of the present invention provides a friction spinning unit including at least one foraminous friction surface having suction applied thereto, means for feeding separated fibres to the friction surface to roll up to form spun yarn in operation of the friction spinning apparatus, and a suction switch responsive to the suction prevailing in said suction-applying means for discontinuing operation of the friction spinning apparatus when the suction sensed by the suction switch deviates from a predetermined range of values.

Preferably the friction spinning apparatus in question is a typical friction spinning unit of multi-position friction spinning machine and the means responsive to the suction switch for shutting down that friction spinning unit comprise the fibre feed means of that friction spinning unit.

More preferably the friction spinning unit includes a primary suction system to the inside of a foraminous friction spinning roller of the friction spinning unit, and an additional suction line to apply suction forces along the yarn formation line outside the or each friction spinning suction roller, the suction switch being connected in said additional suction line.

Advantageously the suction switch is a pressure transducer delivering an electrical signal to disengage a drive clutch to the sliver feed roller of the friction spinning unit.

A second aspect of the invention provides a method of operating a friction spinning unit, comprising continuously monitoring the suction applied to that friction spinning unit and disenabling the friction spinning unit when the monitored suction value deviates outside a predetermined range of acceptable suction values.

BRIEF DESCRIPTION OF THE DRAWINGS

In order that the present invention may be more readily understood the following description is given, merely by way of example, with reference to the accompanying drawing in which the sole Figure shows schematically a friction spinning unit in accordance with the present invention.

DESCRIPTION OF THE PREFERRED EMBODIMENT

The drawing shows a typical fibre feed duct 2 delivering fibres to a pair of friction spinning rollers 1, one of which is visible in the drawing. The fibres are individually transmitted along the fibre feed duct from a beater unit 16 where a toothed or pinned beater roller 17 combs out individual fibres from an incoming sliver 18, and the fibres are then transported pneumatically down the feed duct 2 towards the foraminous surface of the suction roller 1. The other friction spinning roller, not shown in the drawing, may be foraminous or may be imperforate, as is well known in the art.

Suction within the foraminous roller 1 is transmitted via a main suction line 3. An additional suction line 4 connected to the line 3 at point 9 is connected also to a point 8 near the outlet end of the fibre feed duct 2, but in such a position as to generate a flow of air rightwardly along the yarn formation line outside the foraminous roller 1. A suction tapping 5 connected to the additional suction line 4 also communicates with a suction transducer 6 which is in turn able to deliver an electrical signal for disenabling the feed clutch 7 to the sliver feed roller 19 which conveys sliver to the toothed or pinned beater roller 17 of the fibre-opening unit.

In use of the illustrated friction spinning unit, suction is applied to the main suction line 3 and the additional suction line 4 from a suction source, not shown, applying suction to a series of suction pipes 10 from a common suction manifold, each of the pipes 10 communicating with the respective main suction line 3 by way of a releasable coupling to allow removal of the friction spinning units, for example for maintenance purposes.

In the event of a fibre build-up occurring at the point 8, the strength of the suction-induced airflow along the yarn formation line is attenuated, and although the friction spinning unit still continues to deliver yarn without a yarn break occurring unless a very severe disruption of the suction forces results, the quality of the yarn will vary from the optimum value. The existence of such a blockage will, however, manifest itself at the pressure transducer 6 by the existence of a stronger suction (a lower absolute pressure) there due to the fact that the maintained suction value communicated to the friction spinning unit by way of its suction pipe 10 is no longer subject to the same total leakage path through both the main suction line 3 and the additional suction line 4.

Thus, instead of requiring to measure the quality of the yarn which is being delivered at speeds up to 300 m/min in order to monitor the quality of the production, it is possible to relate the variation of yarn quality, for example its varied strength, to the deviation of the suction value and to set the suction monitoring switch including the suction transducer 6 to disengage the clutch 7 once the yarn quality is likely to lie outside acceptable limits. Effectively, therefore, the suction monitoring system employing the suction transducer 6 provides a simple measure of yarn quality which constantly monitors the operating performance of the friction spinning unit and ceases production of yarn at any one of the friction spinning units of a multi-position machine where, for example due to a localised partial blockage of the suction system, the quality of yarn will have deviated beyond a predetermined adjustable tolerance from the optimum value.

Great care is taken in the design of the suction systems to avoid fibre entrapment sites, for example by ensuring that the edges of the suction lines at the junctions are smooth and the suction surfaces polished, and by ensuring that where one suction line joins another (for example the suction tapping 5 joining the additional suction line 4, or the suction line 4 joining either the fibre feed duct at 8 or the main pressure line 3 at 9) the joining line ends flush with the wall surface of the other line which it joins. However, there is always the possibility of some fibre build-up which rapidly increases as fresh fibres accumulate at the nucleus site formed by the first few collecting fibres. This can give rise to localised variation of suction which will alter the quality of the spun yarn but without necessarily leading to a yarn break. In accordance with the present invention we close down that friction spinning unit long before a yarn break caused by excessive quality impairment occurs, and the friction spinning unit in question is then cleaned and serviced before re-piecing.

Although above we have mentioned the point 8 as one likely site for fibre build-up, it is of course possible for fibre build-up instead to occur at point 9, in which case the suction sensed by the transducer 6 will be attenuated but will still lie outside the optimum suction range and will, therefore, lead the suction switch comprising the transducer 6 and the clutch 7 to shut-down that spinning unit.

A third possible blockage condition is if blockage occurs in the suction insert within the perforated friction spinning roller 1 in which case again the total leakage path for the suction applied at the suction pipe 10 will decrease, giving rise to a stronger suction at the transducer 6.

It will of course be appreciated that a sophisticated control unit may be incorporated in the pressure switch between the transducer 6 and the clutch 7, in order to allow adjustment, from unit to unit, of the range of suction values within which the friction spinning unit can operate before the fibre feed clutch 7 is disengaged.

The monitoring of the suction is of course one of many parameters which will be monitored in use of the friction spinning unit.

As an example, it is possible for a management system for the friction spinning unit to include a controller generally designated 11 having one input 12 which is responsive to the yarn properties, and also another input 13 from the suction switch in accordance with the present invention. One possibility is for a multi-channel monitoring system including (i), on the input 12, a signal from a yarn monitoring head 14 which is indicative of the linear density of the yarn 15 and which can be analysed to provide for one channel recording the number of "thick places" in the yarn, and another channel monitoring the number of "thin places" in the yarn, and (ii), on the input 13, the electrical signal from the suction transducer 6. The management system shuts down the friction spinning unit in the event of the measured suction deviating from the desired value sufficiently to operate the suction transducer 6. The tolerance of the suction deviation permitted may be adjusted by means of a tolerance adjustment sub-assembly **11*a* of the controller 11**.

Such a management system has the advantage of (a) logging the thick and thin places in the yarn, and possibly in indicating the individual spinning unit by way of an alarm system, or even shutting it down, when the frequency of such events exceeds a value preselected by means of a frequency selector sub-assembly **11*b* of the controller 11**, and (b) not only giving an alarm on shutting down the friction spinning unit when the pressure switch signal deviates from the norm, but also recording the reason for that alarm or shut down so that repetitive suction problems on a given friction spinning unit will be highlighted in the print-out analysis offered by such a management system.

Although the accompanying drawing shows one input 12 and on input 13 to the management system controller 11, it will of course be appreciated that such a monitoring/management system will normally be centralised for an entire multi-position spinning machine and will receive individual inputs from the various spinning units and from the respective yarn monitors 14 associated therewith, and will equally control each of those spinning units in response to its suction and yarn linear density signals.

Such a system offers not only quality control of the yarn, but also an assurance that yarn will not be spun if the friction-controlling forces (e.g. suction) are outside the expected range (bearing in mind that suction which is one of the key factors in the yarn-to-surface friction in a friction spinning unit).

We claim:

1. A friction spinning unit including:

(a) foraminous friction means having a foraminous surface;

(b) means for feeding separated fibres to the foraminous friction surface means to roll up to form spun yarn in operation of the friction spinning unit;

(c) suction applying means having a first suction line to apply suction from within said foraminous friction means to said foraminous surface to hold the fed fibres thereon; a second suction line to said suction applying means to apply suction from outside said foraminous friction means to said foraminous surface; and (d) suction switch means responsive to the suction prevailing in said second suction line and operative to discontinue operation of the friction spinning unit when the suction sensed by the suction switch deviates from a predetermined range of values.

2. A friction spinning unit according to claim 1, wherein said means for feeding separated fibres includes: feed duct means for guiding a stream of airborne fibres towards the exterior of said hollow suction roller; sliver feed means; fibre separating means for separating individual fibres from a said fed sliver, and said second suction line connected to one of said main suction line and said first suction line, for inducing airflow within said fibre feed duct but externally of the hollow suction roller.

3. A friction spinning unit according to claim 2, wherein said suction switch means comprises a suction transducer connected to said second suction line.

4. A multi-position friction spinning machine including a plurality of said friction spinning units according to claim 2, each having a respective said suction switch means connected to the respective sliver feed means of the friction spinning unit.

5. A multi-position friction spinning machine according to claim 4, and including adjustable control means between said suction transducer and said sliver feed means, for adjusting the predetermined range of suction values within which drive to the sliver feed means is maintained for maintaining spinning of yarn at that friction spinning unit.

6. A multi-position friction spinning machine according to claim 4, including a drive clutch of the sliver feed means at that friction spinning unit, and including means applying an electrical signal from the suction switch means to said drive clutch.

7. A multi-position friction spinning machine according to claim 5, including a drive clutch of the sliver feed means at that friction spinning unit, and including means applying an electrical signal from the suction switch means to said drive clutch.

8. A friction spinning unit according to claim 1, including a yarn monitoring head monitoring the quality of yarn produced by that spinning unit; and a control unit associated with the spinning unit and responsive to both the suction switch means and said yarn monitoring head for monitoring the yarn quality and shutting down that friction spinning unit if a threshold level of fault frequency is exceeded, and for also shutting down that friction spinning unit when the suction value first deviates from an acceptable range of values.

9. A friction spinning unit according to claim 8, wherein said control unit includes means for adjusting said acceptable range of values.

10. A friction spinning unit according to claim 8, wherein said control unit includes means for adjustably selecting said threshold level of fault frequency.

11. A method of operating a friction spinning unit, comprising continuously monitoring the suction applied to that friction spinning unit and the quality of yarn produced by that friction spinning unit; indicating when a selected threshold value of yarn fault frequency has been exceeded on that friction spinning unit; and disenabling the friction spinning unit when the monitored suction value deviates outside a predetermined range of acceptable suction values.

12. A method according to claim 11, further including the step of automatically shutting down said friction spinning unit when the selected threshold value of yarn fault frequency has been exceeded.

13. A friction spinning unit including:

(a) foraminous friction surface means;

(b) means for feeding separated fibres to the foraminous friction surface means to roll up to form spun yarn in operation of the friction spinning unit;

(c) means applying suction to said foraminous friction surface means to hold the fed fibres thereon;

(d) suction switch means responsive to the suction prevailing in said suction-applying means and operative to discontinue operation of the friction spinning unit when the suction sensed by the suction switch means deviates from a predetermined range of values;

(e) yarn monitoring means to monitor the yarn quality produced from said unit; and (f) a control unit connected to said suction switch means and said monitoring means of said unit, said control unit including fault frequency responsive means adapted to respond to yarn fault frequencies of the unit to shut down the unit when the yarn fault frequency exceeds a present value and also to shut down that unit when the suction value deviates from an acceptable range of values, said control unit being adapted to detect both yarn faults and suction changes.

14. A friction spinning unit according to claim 13, including a main suction line, and wherein said foraminous friction surface means comprises a hollow suction roller and wherein said suction-applying means includes a first line suction line connected between said main suction line and the interior of said hollow suction roller.

15. A friction spinning unit according to claim 14, wherein said means for feeding separated fibres includes: feed duct means for guiding a stream of airborne fibres towards the exterior of said hollow suction roller; sliver feed means, drive means actuating the sliver feed means,; fibre separating means for separating individual fibres from a said fed sliver; and a second suction line connected to one of said main suction line and said first suction line, for inducing airflow within said fibre feed duct but externally of the hollow suction roller.

16. A friction spinning unit according to claim 15, wherein said suction switch means comprises a suction transducer connected to said second suction line.

17. A multi-position friction spinning machine including a plurality of said friction spinning units according to claim 15, each having a respective said suction switch means connected to control the drive means of the respective sliver feed means of the friction spinning unit.

18. A multi-position friction spinning machine according to claim 17, and including adjustable control means between said suction transducer and said sliver feed means, for adjusting the predetermined range of suction values within which drive to the sliver feed means is maintained for maintaining spinning of yarn at that friction spinning unit.

19. A multi-position friction spinning machine according to claim 17, wherein said drive means of said sliver feed means includes a drive clutch of the sliver feed means at that friction spinning unit, and including means applying an electrical control signal from the suction switch means to said drive clutch.

20. A multi-position friction spinning machine according to claim 18, wherein said drive means of said sliver feed means includes a drive clutch of the sliver feed means at that friction spinning unit, and including means applying an electrical control signal from the suction switch means to said drive clutch.

* * * * *